US006517907B1

(12) United States Patent
Henriksen

(10) Patent No.: US 6,517,907 B1
(45) Date of Patent: Feb. 11, 2003

(54) METHOD OF PERFORMING AN IMPREGNATING OR EXTRACTING TREATMENT ON A RESIN-CONTAINING WOOD SUBSTRATE

(75) Inventor: Ole Henriksen, Alborg (DK)

(73) Assignee: FLS Miljo A/S (DK)

( * ) Notice: Subject to any disclaimer, the term of this patent is extended or adjusted under 35 U.S.C. 154(b) by 0 days.

(21) Appl. No.: 09/831,604

(22) PCT Filed: Nov. 4, 1999

(86) PCT No.: PCT/DK99/00600

§ 371 (c)(1),
(2), (4) Date: Jun. 18, 2001

(87) PCT Pub. No.: WO00/27547

PCT Pub. Date: May 18, 2000

(30) Foreign Application Priority Data

Nov. 10, 1998 (DK) ..... 1998 01455

(51) Int. Cl.[7] ..... B05D 1/18
(52) U.S. Cl. ..... 427/440; 427/297
(58) Field of Search ..... 427/440, 297

(56) References Cited

U.S. PATENT DOCUMENTS

| | | | | |
|---|---|---|---|---|
| 4,992,308 | A | 2/1991 | Sunol | 427/297 |
| 5,041,192 | A | 8/1991 | Sunol et al. | 162/63 |
| 5,094,892 | A | 3/1992 | Kayihan | 427/440 |
| 5,364,475 | A | 11/1994 | Levien et al. | 134/42 |
| 5,476,975 | A | 12/1995 | Ruddick et al. | 568/762 |
| 5,785,856 | A | 7/1998 | Gleave et al. | 210/634 |

FOREIGN PATENT DOCUMENTS

| | | |
|---|---|---|
| DE | 4202320 | 8/1993 |
| DE | 4223029 | 3/1994 |
| DE | 4404839 | 8/1995 |
| DK | 145698 | 11/1998 |
| EP | 0480476 | 4/1992 |
| EP | 0506041 | 9/1992 |
| EP | 0546452 | 6/1993 |
| JP | 59101311 | 6/1984 |
| WO | WO953460 | 12/1995 |
| WO | 9816288 | 4/1998 |

OTHER PUBLICATIONS

Morrell, J.J., et al. "Development of New Treatment Processes for Wood Protection" (no date).
Van Oost, et al. "Traitement de L'épicéa en Milieu Supercritique", Info Critt N° 6 (no date).
International Search Report dated Jan. 27, 2000.
DATABASE WPI, Section Ch. Week 9139, Derwent Publication Ltd., London, GB; Class D22, AN 91–286207, XP002099139 & JP 59 101311 A (Nippon Sanso KK), Jun. 11, 1984, abstract.

*Primary Examiner*—Katherine A. Bareford
(74) *Attorney, Agent, or Firm*—Ostrolenk, Faber, Gerb & Soffen, LLP

(57) ABSTRACT

The impregnating or extracting treatments of resin-containing wood substrate using a resin-soluble supercritical fluid as delivering or extractive solvent medium problems due to exudation of resin from the wood substrate at pressure release necessary before the termination of the treatment are avoided or reduced by displacing at least partially the supercritical fluid by a fluid of relatively low solubility in the resin before pressure release down to atmospheric pressure is terminated, thereby the total process time can be substantially reduced.

20 Claims, 4 Drawing Sheets

METHOD OF PERFORMING AN IMPREGNATING OR EXTRACTING TREATMENT ON A RESIN-CONTAINING WOOD SUBSTRATE

FILED OF THE INVENTION

The present invention relates to impregnation of wood using a supercritical fluid as carrier for the substance impregnated into the wood.

More particularly the invention relates to impregnating treatment of resin-containing wood and enables an expansion of the field of wood treatments using fluids in supercritical state.

BACKGROUND OF THE INVENTION AND PRIOR ART

Use of fluids under supercritical conditions offers substantial advantages in operations involving perfusing of a porous material for impregnation.

The advantages of using fluids under supercritical conditions over conventional processes using organic solvents or water as carrying medium at conditions of temperature and pressure in which the liquid stage is maintained, can be important and include the following features.

Supercritical fluids, possibly including minor amounts of co-solvents, are able to perfuse or penetrate porous materials quicker and more efficient than liquids, thereby enabling a more uniform impregnation in the interior of the material being treated and also enabling impregnation of materials regarded as a nearly impermeable to liquids.

The fact that supercritical fluids are almost as dispersible as gases facilitates an even contact with the porous substrate to be treated. Further, the fact that the solubility of several substances in super-critical fluids is highly pressure dependent enables an efficient deposition of such substances in the interior of the porous substances by pressure reduction following impregnation with supercritical solutions at higher pressures.

Supercritical fluids have also been suggested for the extraction, and especially the impregnation, of wood where the potential advantages include not only improved efficiency of the treatments but also involve substantial environmental improvements both in the performing of the treatment and possible post conditioning and in the subsequent use and disposal of the treated wood articles.

For further description of supercritical fluid treatments of wood materials reference is made to the following.

An article of Morrell & Levien: "Development of New Treatment Processes for Wood Protection" Conference Report from "Conference on Wood Preservation in the '90s and Beyond", Savannah, Ga., USA, Sep. 26–28, 1994, which deals with impregnation of wood species normally resistant to impregnation, by using supercritical carbon dioxide to deliver and deposit biocides into said wood. The potential for completely impregnating virtually all wood species also with biocides not previously regarded as suitable, is discussed. The supercritical fluid treatments are described as representing the first truly revolutionary improvement in treatment in this century, although it is admitted that a substantial amount of research and testing will be required before these systems become commercially feasible.

Also a paper by Herve van Oost, Philippe Eymard and Michel Gastiger: "Traitement de l'épicéa en milieu supercritique", Info Critt No. 6, 1995, provides a general description of the use of supercritical fluids for conservating treatment of wood, especially spruce. Based on laboratory experiments using carbon dioxide as supercritical fluid with possible addition of alcohol it is expected that the technique could be developed into commercial scale not only for introducing pesticides, but also for impregnation of wood with a view of improving physical characteristics thereof.

U.S. Pat. No. 5,094,892 comprises a review of prior art methods utilizing supercritical fluids for various purposes comprising deposition of various materials into a porous substrate or extraction of materials from such substrates. The latter process may be performed to recover valuable extracts or to improve characteristics of the substrate. The patent concentrates on the improvement obtainable by using co-solvents when perfusing wood, using typically carbon dioxide as supercritical fluid. Among the advantages also this patent emphasizes a uniformly impregnating of otherwise difficultly permeable materials.

Similar information can be found in U.S. Pat. No. 4,992,308 which i.a. describes impregnation using monomers which are polymerized in situ.

U.S. Pat. Nos. 5,364,475 and 5,476,975 both deal with the extraction of organic toxic contaminations from wood using supercritical carbon dioxide.

Also delignification of wood has been suggested in the above mentioned U.S. Pat. No. 4,992,308 and in U.S. Pat. No. 5,041,192.

WO-A-95/34360 describes an analytical extraction process using a solvent under high temperature and pressure but not in the supercritical state. After the extraction a purging or flushing step is performed which transports the extraction fluid into a collection chamber. The purging or flushing step utilize another fluid than the one used in the extraction process.

U.S. Pat. No. 5,785,856 describes an apparatus that is particular adapted to perform the extraction process described in WO-A-95/34360 in an automated fashion, but which also may be operated under supercritical conditions. An example of suitable purging fluid is nitrogen under high pressure. It is notes that beside transporting the extraction fluid to a collection chamber the purging step has the further advantage of drying the extracted material.

In spite of the fact that treatment of various materials by perfusion thereof to perform or impregnation, in principle may advantageously be carried out using a supercritical fluid as carrier in the perfusion process, such processes have hitherto not found commercial application, at least not at the level which could be expected in view of their potential advantages.

Especially within one of the largest potential application areas, namely in the treatment of wood substrates, these processes have, to the best knowledge of the present inventors, not achieved large-scale commercial use.

The present inventors have conducted extensive research with a view of developing and improving processes of the discussed type, especially for treatment of resin-containing wood substrates.

In the present specification and the attached claims the term "wood substrate" designates a substrate for the impregnation process which may typically be a shaped or partially shaped wood article, structural wood, timber, poles etcetera, but encompasses also materials comprising comminuted wood such as chips or building plates etcetera.

By said research and experiments it has turned out that an important feature which may be at least partly responsible for the lacking or very restricted commercial application of perfusion processes using supercritial fluids in wood products, is the contents of resin in most of such wood products. Such resin may under the influence of the supercritical fluid cause deterioration of the resulting products and/or operational complications.

In this context the term "resin" denotes the high viscous liquid of lipophilic or hydrophobic character present in amounts of typically some percent by weight in most types of wood, especially in wood from coniferous tres. Such resin is a very complex mixture of various substances including relative volatile components such as terpenes, whereas the main component is a mixture of non-volatile, partly unsaturated compounds including esters and free acids. The resin forms an extremely sticky gum which is capable of undergoing a certain slow hardening when exposed to the air.

The resin is normally present as small drops within the cells forming the wood structure.

Most of the substances coming into consideration as supercritical fluid in the wood perfusing processes, coming into consideration herein, including primarily carbon dioxide and hydrocarbons, such as ethane, propane and buthylene, as well as certain auxiliary substances suitable as adjuvants in the fluid, are soluble in resin and during the impregnative perfusion processes a substantial amount thereof is dissolved in the resin present in the interior of the wood.

As can be shown in experiments using samples of pure resin extracted from wood, the viscosity and surface tension of the resin are such that carbon dioxide or volatile hydrocarbons dissolved therein at high pressure in the supercritical perfusion process only escapes slowly when the pressure is reduced and therefore the pressure reduction involves extensive formation of bubbles and foam.

When the superatmospheric pressure, typically 50–100 bar, used in the hitherto suggested processes for perfusion of wood substrates, is released, a similar phenomenon occurs and the bubble formation in the individual droplets of resin causes the resin to be exudated to the surface of the wood substrate from where a part of it may be entrained by the leaving fluid and form deposits on the interior walls and exhaust pipes of the treatment chamber.

In case the wood substrate is a shaped wood article, the resin present as a layer on the surface thereof after termination of the treatment prevents immediate application of further finishing treatments, such as painting, varnishing etcetera, and the surface achieves an inattractive sticky character.

Also on timber and constructional wood intended for subsequent shaping operations the presence of the resin on the surface will often be unacceptable.

Due to the physical character and insolubility in water of the resin, deposits thereof in the chamber and connected pipes may create substantial operational problems and expenditure. These last mentioned problems also exist when the wood substrate is comminuted wood, such as chips or building plates comprising comminuted wood. As mentioned above such materials may be treated for impregnative purposes.

The higher the maximum pressure is in the perfusion process the more pronounced and disturbing are the problems caused by resin exudation. Thus, said problems have in fact made the process unattractive for treating certain difficultly perfusable substrates requiring very high pressure for effective treatment.

As a first attempt to avoid or reduce the problems caused by the above exudation of the resin from the interior of the wood substrate experiments have been made using very slow and thus prolonged exhaustion of the fluid in supercritical state and thus a very slow pressure release.

Although this measure in principle is efficient to mitigate the problems caused by exorbation of resin, it has turned out that to reduce said exorbation sufficiently the pressure release has to be so slow that the time period necessary for completing said pressure release before emptying the treatment chamber becomes so extended that the total capacity of the process and the plant used therein is decreased to levels seriously impairing the competitiveness of the total extraction or impregnation process.

Thus, there is a substantial need for measures to avoid excessive exorbation of resin from wood substrates when these are subjected to pressure release after supercritical fluid perfusion operations, without the necessity of using a prolonged release time. Avoidance of resin exorbation would not only solve or diminish the above problems but also widen the area of applicability for the processes to substrates which can only be perfused at very high pressures, such as wood having a high proportion of heartwood.

Copending Art

One approach to fulfill this need and meet the described problems is subject of the co-pending Danish patent application No. 1456/98, filed the same date as the present application. The present invention fulfils said need using different measures.

SUMMARY OF THE INVENTION

The present invention is based on the recognition that during the pressure release the portion of the fluid used in supercritical state, which is dissolved in the resin, may be allowed to evaporate therefrom relatively fast without formation of bubbles and resin exorbation, if the partial pressure of the substance forming the supercritical fluid is reduced with a higher percentage than the total pressure in the gaseous phase is reduced.

This may be achieved by complete or partial displacement of the supercritical fluid by a second fluid having substantially lower solubility in the resin, which displacement is made before or during pressure release. To enable recovering and reuse of the fluid used as supercritical perfusion medium said second fluid is in the commercial exploitation of the invention only introduced after the pressure release has started, that means after a certain amount of the first mentioned fluid has been recovered.

Thus, the present invention deals with a method of performing an impregnating treatment on a resin-containing wood substrate using a fluid in supercritical state as delivering solvent medium which fluid in supercritical state is soluble in the resin present in the wood substrate, comprising the steps of (i) introducing the wood substrate into a pressure tight treatment chamber, (ii) introducing a stream comprising said fluid into the chamber and adjusting the pressure and temperature therein to ensure the fluid being present in supercritical state and to promote penetration of the fluid and any substances dissolved therein into the wood substrate, (iii) maintaining contact between the wood substrate and fluid in supercritical state for a time period sufficient to obtain the desired penetration, whereby also a certain dissolution of the fluid into the resin takes place, (iv) after a possible purging of the chamber with said fluid in supercritical state, releasing the pressure in the chamber down to ambient pressure, and (v) withdrawing the treated wood substrate from the chamber, and the method is characterized in that the releasing step (iv) comprises the features:

(a) starting releasing the pressure, (b) recovering the fluid exhausted from the chamber during this release, (c) before harmful exudation of resin to the surface of the wood substrate takes place, displacing at least partially the resin-soluble fluid in the chamber by a second fluid being less soluble in resin than the displaced fluid, and (d) continuing the pressure release of the chamber without harmful exudation of resin to the surface of the wood substrate, at a rate which would have caused such resin exudation if the fluid displacement defined in (c) were omitted. As it appears from the introductory portion of this specification, the method of this invention involves advantages for impregnation processes in connection with substrates comprising articles of wood as well as comminuted wood materials and articles comprising such. However, currently most experiments and experiences have been obtained in connection with impregnation of wood as such, and thus a preferred embodiment of the process is characterized in that a resinous wood is impregnated with one or more biocides such as fungicides or insecticides. Tests have especially been carried out using wood from a coniferous tree, preferably selected from spruce (pica), fir (abies, pseudotsuga), hemlock (tsuga) and pine (pinus) including larch (larix), which is impregnated using a wood preserving agent comprising at least one fungicide or other biocide.

The process may also be advantageous for treating hardwood, such as beechwood, to obtain a uniform dying through the complete interior thereof.

Due to physical and chemical properties as well as availability and costs and lacking toxicity and non-flammability, carbon dioxide, possibly together with a minor amount of a solubility promotor such as an alcohol or ketone, is the preferred fluid used in supercritical state when the purpose is to impregnate wood by means of an organic fungicide or insecticide. However, hydrocarbons can also be used for this purpose, especially such having from 2–4 carbon atoms.

However, such hydrocarbons are easily soluble in resin just as carbon dioxide is, and their release from said resin, when the pressure is reduced, may cause the problems explained above.

The second fluid used for the at least partial displacement of the supercritical fluid after the impregnation may typically be nitrogen or atmospheric air which do not dissolve in the resin to such an extent that their release therefrom causes problems.

In a typical application of the process resinous wood from a coniferous tree is impregnated with at least one organic biocide using carbon dioxide as the supercritical fluid acting as delivering solvent medium, and the contact in step (iii) is maintained for 5–60, preferably 10–30, minutes at a pressure of 20–500, preferably 50–400, more preferably 60–150 bar and at a temperature of 31–80° C., preferably 31–65° C., and the step (iv) comprising the features (a), (c) and (d) is completed within a period of 0.5–5 h, preferably 1.5–4 h, more preferably 100–200 minutes.

In case the feature (c) comprising introduction of a second fluid less soluble in resin than the carbon dioxide according to the invention were omitted, the step (iv) comprising release of pressure down to atmospheric pressure enabling opening and emptying of the chamber, should have been prolonged up to typically 20 h.

Addition of certain organic solvents to the supercritical fluid, especially when the latter is carbon dioxide, has been described as widening the pores of wood substrates to be perfused. Further, such solvents may be selected to improve the solubility of certain biocides or other substances which it is desired to impregnate into the wood substrate.

Thus, a preferred embodiment of the method is characterized in that to increase the delivering ability of the fluid in supercritical state an organic co-solvent is added to said fluid.

Solvents can also be used with the purpose of bringing the substance(s) to be infused into the substrate in liquid, low viscous state to facilitate handling and especially dosing thereof.

In case the method is used for impregnating wood substrates to resist attack from fungi and/or insects, several biocides come into consideration.

Thus, as example of suitable fungicides copper salts, such as copper naphtenate and copper linolate and similar derivatives may be mentioned.

Also propiconazole or tebuconazole are fungicides which currently are accepted and commercially used for wood impregnation.

Experiments have shown that these two fungicides by the method of the invention using carbon dioxide as supercritical fluid can be dispersed evenly in the wood in concentrations sufficient for the desired preservation. Especially a combination of propiconazole and tebuconazole seems suitable.

However, the process of the invention is in no way restricted to biocide impregnation of wood substrate, but it is also suitable for impregnation of wood substrate with one or more of the species of the groups: colorants, fireproofing agents, and other agents imparting specific qualities, e.g. strength-improving agents such as agents which are polymerized in situ after having been dispersed within the wood structure.

To further explanation of the invention and certain embodiments thereof reference is made to the drawings.

DETAILED DESCRIPTION

For general information concerning equipment suitable for impregnation treatments using supercritical fluids reference is made to the above cited literature and patents, all incorporated herein by reference.

Figure 1:
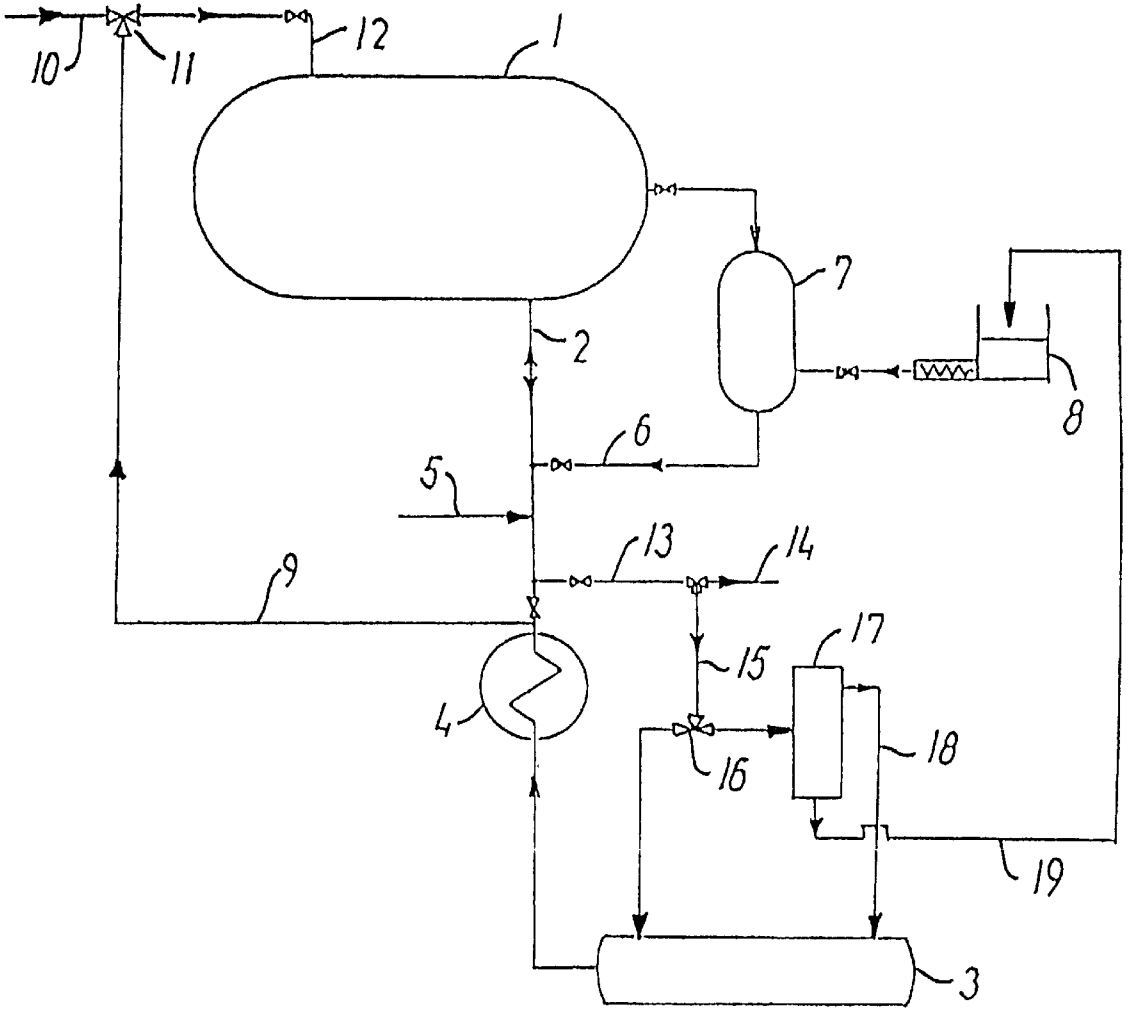
FIG. 1 very schematically depicts a layout for a plant suitable for performing typical embodiments of the method of the invention.

FIG. 1 schematically shows principal elements in an embodiments of a plant suitable for carrying out an impregnation embodiment of the method of the invention, however, omitting pumps, probes, pressure and flow indicators, thermometers and other equipment for monitoring the method.

Also equipment for automation of the process is omitted, since various measures for this purpose will be evident to the person skilled in the art.

On FIG. 1 an impregnation chamber 1 is built to withstand an interior pressure of up to e.g. some hundreds bar. The chamber is provided with at least one large dimensioned port or lid for introducing of wood to be impregnated and for removal thereof after completion of the impregnation process. Said port or lid is not shown on the drawing.

The chamber 1 is connected to various conduits.

Thus, 2 is a conduit for introducing and removal of supercritical fluid and other substances as will appear from the below more detailed explanation.

For the sake of simplicity it is in the following assumed that the fluid used in supercritical state is carbon dioxide.

The main reservoir for carbon dioxide is the tank connected to the chamber 1 through the conduit 2.

A heat exchanger 4 is provided for adjusting the temperature of the carbon dioxide pumped from the tank 3 to the chamber 1.

A conduit 5 enables introduction of one or more co-solvents into the stream of carbon dioxide to increase the solubilizing ability of the latter towards the biocide(s) or other substance used in the process.

A conduit 6 provides adjustable connection between the conduit 2 and an enrichment unit 7. This unit 7 also receives a conduit directly from the chamber 1.

8 is a reservoir for biocide or other impregnating substance, preferably as a solution in an organic solvent. The contents of the reservoir 8 can be adjustably dosed to the unit 7.

A conduit 9 enables delivery of carbon dioxide from conduit 2, in the shown embodiment from a location downstream of the heat exchanger 4, to the impregnation chamber 1 to introduce essentially biocide-free carbon dioxide therein.

A conduit 10, which is of special relevance in connection with the present invention, enables introduction of a fluid having a lower solubility in resin than the solubility of carbon dioxide therein. A multi-functional valve 11 combined with other adjustment systems controls whether this fluid or carbon dioxide shall be introduced into the chamber through a conduit 12 or whether passage therethrough shall be closed.

In case the plant has two or more impregnation chambers (not shown), the valve 11 may be part of a manifold unit.

The conduit 2 also serves to remove fluid from the chamber 1, in which case said fluid passes to conduit 13 from where it can be either vented through 14 or passed to a further conduit 15 from where it, by means of a valve 16 is directed either to the tank 3, which applies if the fluid is substantially pure carbon dioxide, or to a separator unit 17 in which separation into relative pure carbon dioxide and non-used biocide is performed.

The carbon dioxide is through conduit 18 conducted to the tank 3 whereas the fungicide through conduit 19 is lead to the biocide reservoir 8.

When performing an embodiment of the present method, the depicted plant may for instance be used as follows:

When using the plant depicted in FIG. 1 for biocide impregnation of wood, a first measure will typically be to introduce the wood to be impregnated into the chamber 1. Due to the high and quick perfusion of supercritical fluids the wood may be packed very dense in said chamber without taking such measures to ensure an even distribution of the fluid which are necessary in conventional impregnation processes using liquid carrier for the biocides.

After introduction of the wood into the chamber 1 the latter is closed and introduction of carbon dioxide from the tank 3 via the heat exchanger 4 is made through conduit 2. From the conduit 5 this supply of carbon dioxide receives a suitable amount of co-solvent, typically some percent by weight of alcohol or ketone.

During this part of the process the conduit 12 is closed.

Introduction of carbon dioxide, possibly with the additives mentioned is continued until the pressure in the chamber 1 is approximately 120 bar and the temperature e.g. approximately 50° C.

The time used for reaching the desired pressure will typically be from a few minutes up to 30 minutes.

Figure 2:
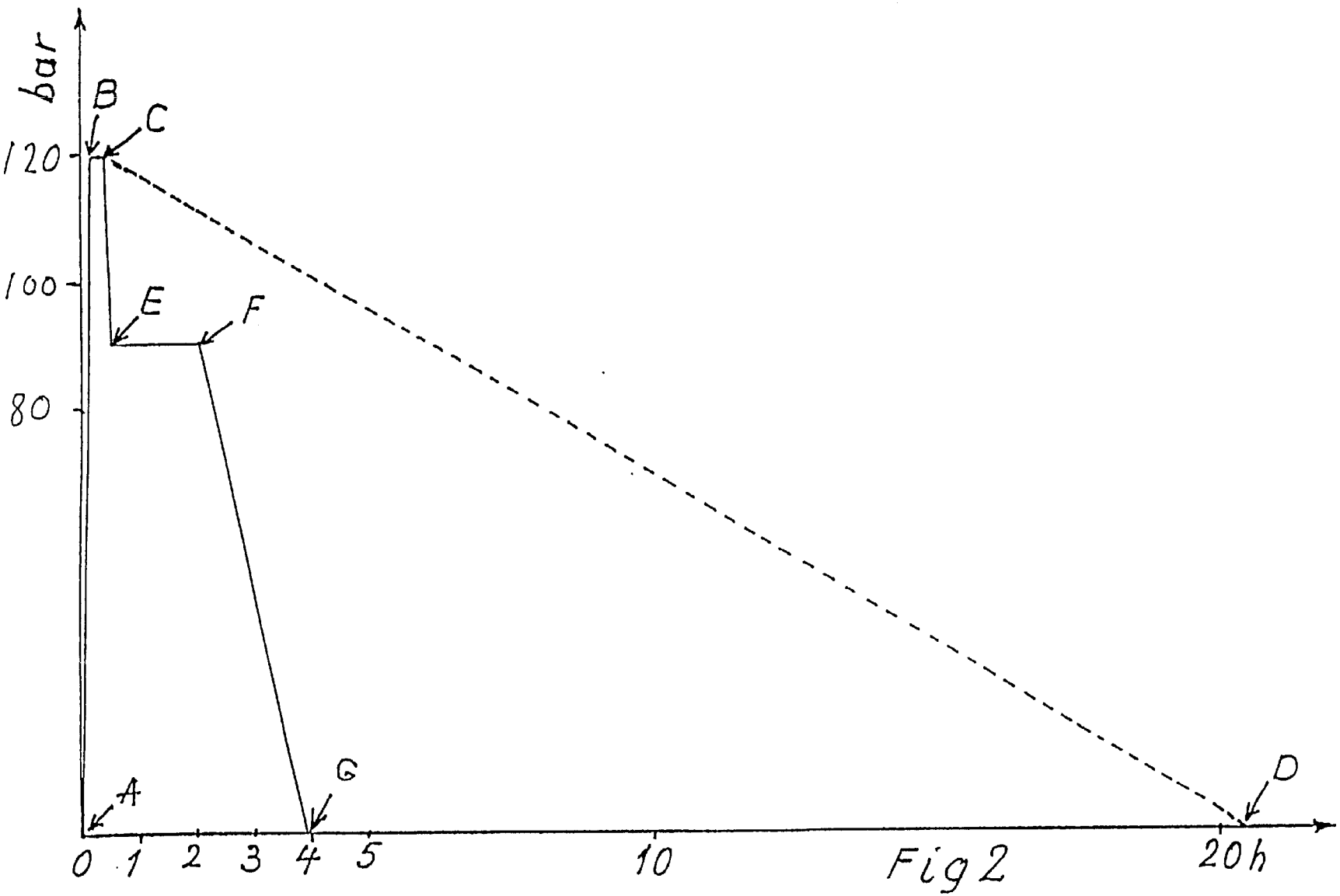
FIG. 2 is two graphs depicting the pressure as a function of the treatment time in an embodiment of the method of the invention and in a conventional method, resp.

On FIG. 2 showing a graph indicating the pressure in bar as function of the time expressed in hours, this portion of the method corresponds to the line from point A to point B. Remark that the ordinate axis is not drawn to scale.

At this time a circulating flow is initiated from the chamber 1 to the unit 7 and from there through the conduits 6 and 2 back to the chamber 1. During this circulation the carbon dioxide is enriched with biocide or other substance introduced from the reservoir 8, and the carbon dioxide circulation is continued until the desired amount of biocide or other substance has been dissolved in and entrained by the carbon dioxide flow.

The pressure in the impregnation chamber 1 is maintained at approximately 120 bar for e.g. 20 minutes. This corresponds to the portion B–C of the graph on FIG. 2.

At the termination of this part of the method carbon dioxide without biocide can be blown through the chamber 1. This may be accomplished by conducting carbon dioxide at suitable temperature through the conduit 9, the valve 11 and the conduit 12.

This carbon dioxide displaces the biocide containing carbon dioxide from the chamber and forces it through the conduits 2, 13 and through valve 16 to the separator unit where, preferably after a suitable pressure reduction, the biocide is separated and conducted via 19 to the reservoir 8, whereas the carbon dioxide essentially free of biocide is lead via conduit 18 to the tank 3.

When substantially all biocide not bound in the wood has thus been flushed out of the chamber, the valve 16 may be adjusted to conduct the now essentially pure carbon dioxide reaching said valve directly into the tank 3.

At the moment corresponding to C on FIG. 2 the introduction of carbon dioxide through 9, 11 and 12 is stopped and the pressure in the chamber 1 is decreased by continuing withdrawal of carbon dioxide through 2, 13, 15 and 16 to the tank 3.

If the above described problems caused by the resin in the wood being impregnated were to be avoided simply by reducing the rate of carbon dioxide removal from the chamber, pressure release from the impregnation pressure of 120 bar down to atmospheric pressure would typically take approximately 20 hours. Such a slow or prolonged pressure release is indicated on FIG. 2 by the dotted line from C to D.

However, in a typical embodiment of the present method a partial pressure release takes place within a few minutes as indicated on FIG. 2 by the line from C to E. However, this possibly rather fast pressure release is stopped at point E before any damage due to resin occurs on the surface of the wood or on the inner walls of the equipment.

At the time corresponding to E on FIG. 2 a fluid of only moderate or little solubility in resin, such as nitrogen, is introduced through 10, 11 and 12, thereby displacing the carbon dioxide through 2 and 13. As long as the fluid reaching 13 consists of essentially pure carbon dioxide, this is via 15 and 16 conducted directly to the tank 3, but when the fluid introduced through 10, as mentioned typically nitrogen, reaches the conduit 13, the admission to tank 3 is closed and the fluid is vented through 14 or sent to regeneration. In the embodiment depicted the pressure is kept constant during the introduction of fluid through conduit 10, as expressed by the horizontal line on FIG. 2 from E to F. However, the desired result may also be obtained if the pressure is varied through this displacement or purging of the carbon dioxide.

It has turned out that the further pressure release of the chamber 1 can now be performed relatively quickly, that means within a couple of hours or less without creating resin-related problems.

This is reflected by the steep inclination of the line from F to G in FIG. 2.

The reason for this is probably that when the carbon dioxide is removed from the chamber by being displaced by e.g. nitrogen, without extensive reduction of the total pressure, carbon dioxide dissolved in the resin moves therefrom into the gaseous nitrogen by diffusion without formation of bubbles or boiling-like phenomena. When the pressure afterwards is reduced relatively fast, the contents of carbon dioxide in the resin is so low that the release of this small amount of carbon dioxide from the resin may continue without bubbles even at the relative low pressure.

However, the invention is not limited to any specific theory for the reason why the proposed measure enables the dramatic increase of total process capacity as reflected in FIG. 2 where the time from process start to termination of pressure release is reduced by approximately 80%.

After the pressure has been released down to atmospheric, the chamber 1 is opened and the wood withdrawn, ready for immediate delivery to customers without necessity for drying or other conditioning.

The method of the invention is further illustrated by means of the following Comparison and Embodiment Examples.

EXAMPLES

Since the suitability of perfusion processes using carbon dioxide as supercritical fluid for obtaining an efficient impregnation of pinewood is well recognized, the aim of the tests described below are to illustrate conditions resulting in resin exubation and the means for avoiding such exubation by the process of the present invention. Consequently the tests were performed without using any biocide or other wood improving substances.

All tests were made on samples of pinewood dried to a moisture content of approximately 12% b.w. Each sample was a planed rod having the dimensions 2.5×2.5×20 cm.

Carbon dioxide was used as primary gas to form the supercritical fluid. This carbon dioxide was of a grade suitable for foodproducts and having a purity of at least 99.9 vol %.

In the tests, where a displacement gas was used, this was nitrogen or atmospheric air.

Test Equipment

Figure 3:
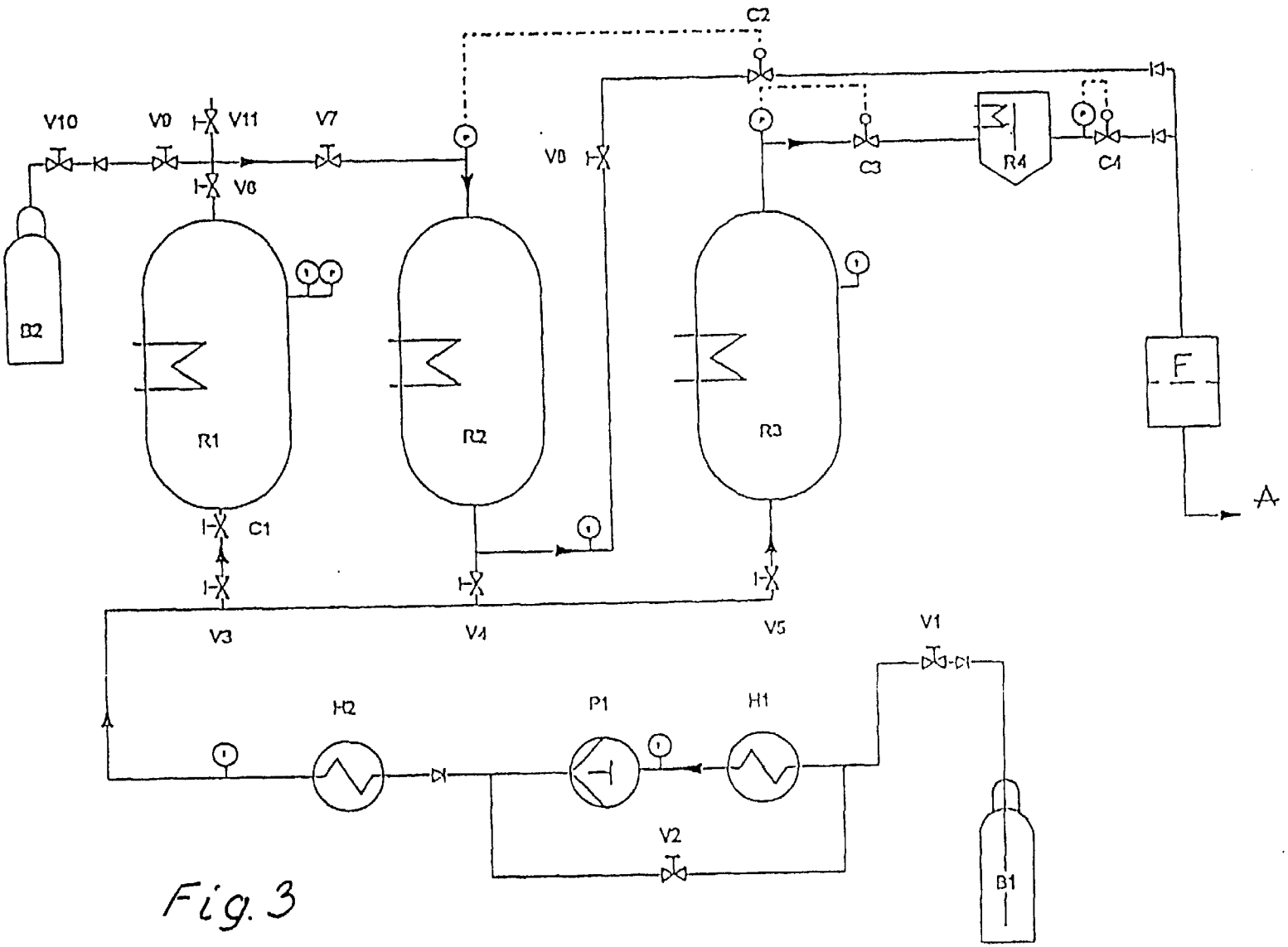
FIG. 3 is a diagrammatical representation of the experimental scale laboratory equipment used in the Embodiment and Comparison Examples described below.

All tests were made using equipment the layout of which is shown in FIG. 3. The various components indicated on this Figure are as follows:

B1: Carbon dioxide reservoir

B2: Displacement or purge gas

V1–V11: Closing valves

C1: Control valve for manual adjustment

C2: Programmable pressure controlling valve having display of the fixed value and the actual value C3, C4: Pressure adjusting valves R1: Heated buffer tank, 1 l., 75° C.

R2: Impregnation reactor, 1 l., 20–80° C.

R3: Dummy reactor, 1 l., 20–80° C.

R4: Separator, 1.5 l., 50° C.

H1: Condenser, −5° C.

H2: Heat exchanger, 20–80° C.

P1: Membrane pump having adjustable flow, 1–14 l./min. at 150 bar

F: Filter

A: Vent

P: Pressure sensors

T: Temperature sensors.

General Procedure

In each test two samples were marked, any special phenomenons such as collapsed cells, resin pockets etcetera were recorded and each sample was divided into two whereafter one half of both samples was placed in R2 while the other half was kept for reference. V1, V2 and V5 were opened, P1 was started and C3 was adjusted to the desired impregnation pressure plus approximately 5 bar. After approximately ten minuts the pump P1 had been cooled sufficiently to allow closure of V2, whereupon the pressure downstream of the pump and in R3 slowly increased to the desired pressure.

Then V3, V6, V7 and V8 were opened. The controller on C2 was started and the pressure in R1 and R2 was adjusted manually by means of C1 until the impregnation pressure was reached. Thereafter V3 was closed and P1 is stopped. When the time for impregnation was finished, V7 was closed and R1 emptied via V11. The pressure in R2 was then adjusted to obtain the desired pressure profile using the programmable pressure adjusting valve C2. When the pressure reached atmospheric pressure, R2 was opened and the samples taken out and inspected. Any changes were recorded.

Comparison Examples

Due to the relatively open cell structure of pinewood, the pressure increase could take place relatively fast, that means approximately 15 bar/min. The pressure was then maintained for twenty minutes (this also applies to the below Embodiment Examples) to simulate an impregnation in which this period is regarded as suitable for the active substances to penetrate into the wood.

Four tests were conducted using a pressure release rate of 10, 1, 0.1 and 0.5 bar/min., resp.

Figure 4:
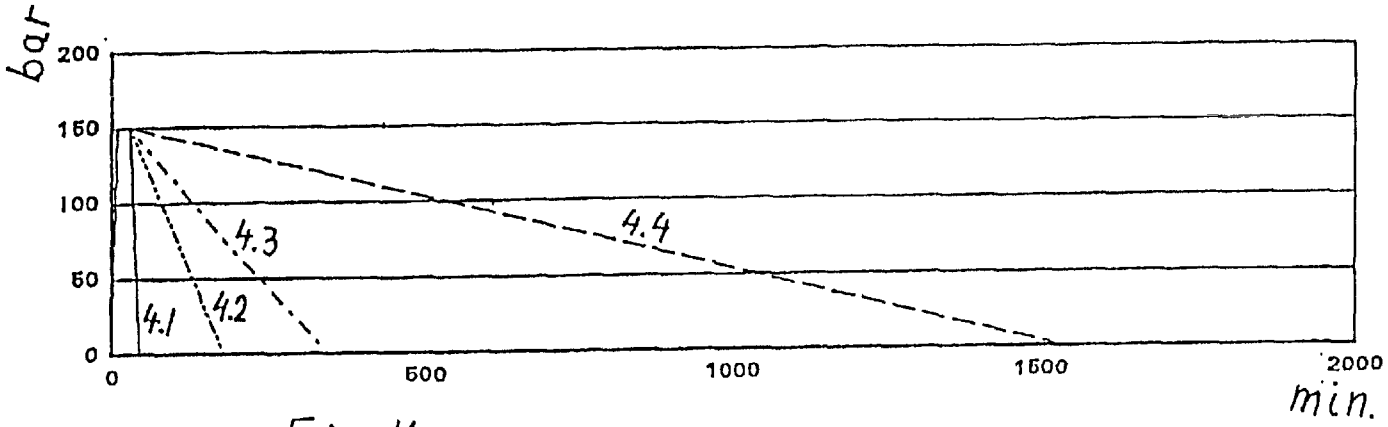
FIGS. 4 and 5 are pressure/time graphs relating to said Comparison and Embodiment Examples, resp.

The pressure release at constant rate in these four tests is illustrated in FIG. 4.

Details concerning these tests and the results as to resin exudation appear from the below Table 1, in which the test numbers correspond to those used in FIG. 4.

TABLE 1

| Pressure Decrease at Constant Rate | | | | |
|---|---|---|---|---|
| Test # | Pressure increase bar/min. | Pressure decrease bar/min. | Process time min. | Result |
| 4.1 | 15 | −10 | 45 | Excessive resin exudation all over on both samples |
| 4.2 | 15 | −1 | 180 | Distinct, unacceptable resin exudation at the sample ends, at autumn wood and around knots |
| 4.3 | 15 | −0.5 | 345 | Very slight/neglectible resin exudation at the end wood and around knots |
| 4.4 | 15 | −0.1 | 1545 | No visible alterations |

As it appears from Table 1, a total process time of more than 5½ hours is required if the quality of the wood surface shall be similar to the one, which can be obtained in the prior art processes. Since these prior art processes use process period from 2–4 hours, it is essential to shorten the process time to make the processes based on supercritical medium competitive.

Examples Using Displacement of Supercritical Medium

In these four tests the pressure increase and residence time at constant elevated pressure were as in the Comparison Examples above. However, the pressure decrease was performed in three stages combined with a displacement of the carbon dioxide in supercritical state by nitrogen, which does not dissolve in the resin.

Figure 5:
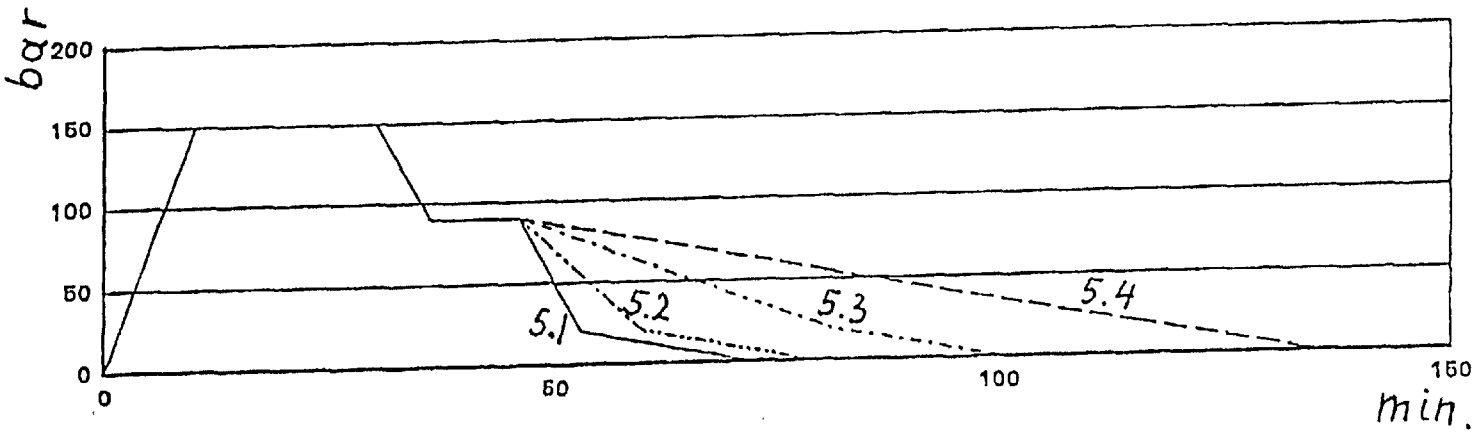

The pressure during the tests appears from FIG. 5. As mentioned, the pressure increase and the impregnation-simulating residence time were as in tests 4.1, 4.2, 4.4 and 4.4 above. Thereafter a fast pressure decrease at −10 bar/min. down to a pressure somewhat above the critical pressure for the carbon dioxide, viz. 90 bar. When the pressure was stabilized at 90 bar, gas replacement or purging were performed in approximately ten minutes by closing V6 and V11 and simultaneous opening of V7, V9 and V10. Thereafter the pressure was reduced down to 20 bar at a rate of −10, −5, −2 and −1 bar/min., resp., and thereafter, in all four tests, from 20 bar down to atmospheric pressure at a rate of −1 bar/min.

Test conditions and results are summarized in the below Table 2, in which the test numbers correspond to those used in FIG. 5.

TABLE 2

| Pressure decrease combined with displacement of resin-soluble supercritical medium. | | | | |
|---|---|---|---|---|
| Test # | Pressure decrease 1 bar/min. | Pressure decrease 2 bar/min. | Process time min. | Result |
| 5.1 | −10 | −1 | 73 | Distinct, unacceptable resin exudation on all surfaces of both samples |
| 5.2 | −5 | −1 | 80 | Distinct, unacceptable resin exudation on the end wood, at autumn wood and around knots |
| 5.3 | −2 | −1 | 101 | Very slight/neglectible resin exudation at the ends and around dense knots |
| 5.4 | −1 | −1 | 136 | No visible alterations |

As it appears from Table 2 it is possible, when using the displacement step according to the invention to achieve an acceptable surface quality of the treated wood samples using a total process time of only approximately 1½ hour. Thereby the process becomes highly competitive to the prior art processes.

What is claimed is:

1. A method of performing an impregnating treatment on a resin-containing wood substrate using a fluid in supercritical state as a delivering solvent medium, which fluid in supercritical state is soluble in the resin present in the wood substrate, comprising the steps of (i) introducing the wood substrate into a pressure tight treatment chamber, (ii) introducing a stream comprising said fluid into the chamber and adjusting the pressure and temperature therein to ensure the fluid being present in supercritical state and to promote penetration of the fluid and any substances dissolved therein into the wood substrate, (iii) maintaining contact between the wood substrate and the fluid in supercritical state and the fluid in supercritical state for a time period sufficient to obtain the desired penetration, whereby also a certain dissolution of the fluid into the resin takes place, (iv) after a possible purging of the chamber with said fluid in supercritical state, releasing the pressure in the chamber down to ambient pressure, and (v) withdrawing the treated wood substrate containing the dissolved fluid and any substances dissolved therein from the chamber, characterized in that the releasing step (iv) comprises the features:

(a) starting releasing the pressure, (b) recovering the fluid exhausted from the chamber during this release, (c) before harmful exudation of resin to the surface of the wood substrate takes place, displacing at least partially the resin-soluble fluid in the chamber by a second fluid being less soluble in resin that the displaced fluid, and (d) continuing the pressure release of the chamber without harmful exudation of resin to the surface of the wood substrate, at a rate which would have caused such resin exudation if the displacement defined in (c) were omitted.

2. A method according to claim 1, characterized in that wood from a coniferous tree, is impregnated using a wood preserving agent comprising at least one species selected from fuingicides and insecticides.

3. A method according to claim 2, characterized in that the wood from a coniferous tree is selected from the group consisting of spruce (pica), fir (abies, pseudotsuga), hemlock (tsuga), pine (pinus) and larch (larix).

4. A method according to claim 2, characterized in that the fluid used in supercritical state as solvent medium is carbon dioxide or one or more hydrocarbons.

5. A method according to claim 4, characterized in that the fluid less soluble in resin than the fluid used as delivering solvent medium is selected from nitrogen and atmospheric air.

6. A method according to claim 4 characterized in that the fluid used in supercritical state as solvent medium is carbon dioxide.

7. A method according to claim 1, characterized in that the fluid used in supercritical state as solvent medium is carbon dioxide or one or more hydrocarbons.

8. A method according to claim 7, characterized in that the fluid less soluble in resin than the fluid used as delivering solvent medium is selected from nitrogen and atmospheric air.

9. A method according to claim 7,characterized in that the fluid used in supercritical state as solvent medium is carbon dioxide.

10. A method according to claim 1, characterized in that resinous wood from a coniferous tree is impregnated with at least one organic biocide using carbon dioxide as the supercritical fluid acting as delivering solvent medium, that the contact in step (iii) is maintained for 5–60 minutes at a pressure of 20–500 bar and at a temperature of 31–80° C., and in that the step (iv) comprising the features (a), (c) and (d) is completed within a period of 0.5–5 h.

11. A method according to claim 10, characterized in that the at least one biocide is propiconazole or tebuconazole or both.

12. A method according to claim 10, characterized in that the biocide is dissolved in an organic solvent before being combined with the carbon dioxide in supercritical state.

13. A method according to claim 10, characterized in that the contact in step (iii) is maintained for 10–30 minutes.

14. A method according to claim 10, characterized in that the contact in step (iii) is maintained at a pressure of 50–400 bar.

15. A method according to claim 10, characterized in that the contact in step (iii) is maintained at a pressure of 60–150 bar.

16. A method according to claim 10, characterized in that the contact in step (iii) is maintained at a temperature of 31–65° C.

17. A method according to claim 10, characterized in that the step (iv) comprising the features (a), (c) and (d) is completed within a period of 1.5–4 h.

18. A method according to claim 10, characterized in that the step (iv) comprising the features (a), (c) and (d) is completed within a period of 100–200 minutes.

19. A method according to claim 1, characterized in that to increase the delivering ability of the fluid in supercritical state an organic co-solvent is added to said fluid.

20. A method according to claim 1, characterized in that the wood substrate is impregnated with one or more of the group consisting of colorants, fireproofing agents, and strength-improving agents.

* * * * *